US009441394B1

(12) United States Patent
Hotes

(10) Patent No.: US 9,441,394 B1
(45) Date of Patent: Sep. 13, 2016

(54) SOLAR FLY FOR TEMPORARY SHELTERS

(71) Applicant: California Industrial Facilities Resources, Inc., Kirkland, WA (US)

(72) Inventor: Douglas T. Hotes, Kirkland, WA (US)

(73) Assignee: CALIFORNIA INDUSTRIAL FACILITIES RESOURCES, INC., Kirkland, WA (US)

( * ) Notice: Subject to any disclaimer, the term of this patent is extended or adjusted under 35 U.S.C. 154(b) by 0 days.

(21) Appl. No.: 13/867,945

(22) Filed: Apr. 22, 2013

Related U.S. Application Data

(60) Provisional application No. 61/653,948, filed on May 31, 2012, provisional application No. 61/636,532, filed on Apr. 20, 2012.

(51) Int. Cl.

| | |
|---|---|
| ***E04H 15/40*** | (2006.01) |
| ***E04H 15/42*** | (2006.01) |
| *E04H 15/16* | (2006.01) |
| *E04H 15/54* | (2006.01) |

(52) U.S. Cl.
CPC ..... *E04H 15/40* (2013.01); *E04H 15/42* (2013.01); *E04H 15/16* (2013.01); *E04H 15/54* (2013.01)

(58) Field of Classification Search
CPC ..... E04H 15/16; E04H 15/18; E04H 15/42; E04H 15/54; E04H 9/14
USPC ..... 135/115, 117, 119, 124, 93, 94, 906, 135/907, 908, 913; 52/3, 4, 23, 63
See application file for complete search history.

(56) References Cited

U.S. PATENT DOCUMENTS

| | | | | | |
|---|---|---|---|---|---|
| 1,136,992 | A | * | 4/1915 | Averitt | E04H 15/42 135/156 |
| 1,530,540 | A | * | 3/1925 | Bouffier | 135/93 |
| 1,856,658 | A | * | 5/1932 | Rummler | 135/93 |
| 2,306,537 | A | * | 12/1942 | Hamm | 135/88.1 |
| 2,948,288 | A | * | 8/1960 | Nelson | 135/88.1 |
| 3,670,747 | A | * | 6/1972 | Pohl et al. | 135/94 |
| 3,715,843 | A | * | 2/1973 | Ballinger | 52/3 |
| 3,970,096 | A | * | 7/1976 | Nicolai | 135/94 |
| 4,601,136 | A | * | 7/1986 | Watanabe | 52/63 |
| 4,649,947 | A | * | 3/1987 | Tury et al. | 135/97 |
| 4,667,692 | A | * | 5/1987 | Tury et al. | 135/156 |

(Continued)

FOREIGN PATENT DOCUMENTS

| | | | | | |
|---|---|---|---|---|---|
| DE | 102005000958 | A1 | * | 7/2006 | A61H 33/06 |
| FR | 2788076 | A1 | * | 7/2000 | E04H 15/54 |

(Continued)

*Primary Examiner* — Noah Chandler Hawk
(74) *Attorney, Agent, or Firm* — Kenyon & Kenyon LLP

(57) ABSTRACT

A shade cover or "solar fly" is provided for reducing the thermal radiation effects of the sun on an associated shelter. By blocking the sun's rays to a significant degree, the outer surface temperature of an associated shelter is reduced, which results in less heat transfer into the interior space thereof. The shade cover and associated shelter may be cooperatively configured to employ natural convection to aid in reducing heat transfer into the interior space of the associated shelter. Natural convection known as the chimney effect may be used to reduce heat transfer into the interior space of the associated shelter. Such reduction of heat transfer into the interior space reduces the air conditioning load needed to maintain the interior space of the associated shelter at ambient temperatures of, for example, 76-84 degrees Fahrenheit among others.

15 Claims, 7 Drawing Sheets

(56) References Cited

U.S. PATENT DOCUMENTS

| | | | | |
|---|---|---|---|---|
| 4,707,953 | A * | 11/1987 | Anderson et al. | 52/63 |
| 6,865,852 | B2 * | 3/2005 | Gower | 52/222 |
| 7,240,684 | B2 * | 7/2007 | Yang | 135/88.07 |
| 7,310,913 | B2 * | 12/2007 | Pierce | 52/23 |
| 7,395,869 | B2 * | 7/2008 | Schnabel et al. | 169/48 |
| 8,869,814 | B2 * | 10/2014 | Jin | 135/94 |
| 2007/0209291 | A1 * | 9/2007 | Perez | 52/23 |
| 2007/0266644 | A1 * | 11/2007 | Weicht | 52/3 |
| 2009/0188539 | A1 * | 7/2009 | Hollinger | 135/115 |

FOREIGN PATENT DOCUMENTS

| | | | | |
|---|---|---|---|---|
| GB | 2340511 | A * | 2/2000 | E04H 15/54 |
| WO | WO 8402065 | A1 * | 6/1984 | E04H 15/34 |

* cited by examiner

SOLAR FLY FOR TEMPORARY SHELTERS

CROSS-REFERENCES TO RELATED APPLICATIONS

This application claims the benefit of U.S. Provisional Application No. 61/636,532, filed Apr. 20, 2012, and U.S. Provisional Application No. 61/653,948, filed May 31, 2012, the disclosures of which are hereby incorporated by reference.

BACKGROUND

Portable shelters are commonly used by the U.S. military and commercial contractors, such as aid and disaster relief agencies, and are occupiable for temporarily housing personnel, equipment, and/or supplies, or for providing services such as cooking, dining or medical care. Ideally, such shelters should be designed for storage in a compact configuration that can be easily transported to a new destination for assembly. Preferably, the assembly and disassembly process should be relatively quick and easy and require few hand tools.

For such uses and others, such shelters may be used in hot external environments. In that regard, some temporary shelters employ air conditioners to condition the interior space thereof. As known in the art, air conditioners are large users of power. Such power is usually generated by fuel-powered generators due to the portable nature of the shelters and the remote locations where these shelters find their primary use. Also known in the art, the fuel to operate the generators is quite expensive to purchase and/or transport in such remote locations.

Therefore, there is a need in the portable shelter industry to reduce the amount of power, and the associated expense, needed to cool the interior spaces of portable shelters in hot external environments.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with aspects of the present disclosure, a shelter system is provided. The shelter system includes a shelter including a roof, a plurality of side walls, and an enclosed interior space, a flexible outer cover mounted over at least a portion of the shelter, and a plurality of spacers positioned between the shelter and the outer cover so as to support the outer cover a spaced distance outwardly of the shelter, thereby creating an air cavity between an inner surface of the shade shelter and an outer surface of the shelter.

In accordance with another aspect of the present disclosure, a shelter system is provided. The shelter system includes a shelter including a roof, a plurality of side walls, and an enclosed interior space. In some embodiments, the shelter is formed by a frame having a plurality of spaced apart, arched frame members and an outer cover supported by the frame and formed of a flexible material. The shelter system also includes a shade cover formed of a flexible material and mounted over a majority of the roof and side walls of the shelter. The shade cover in some embodiments includes one or more sections formed of solid, flexible material. The shelter system further includes a plurality of spacers configured to support the shade cover a spaced distance from the shelter so as to define one or more air cavities therebetween.

In accordance with another aspect of the present disclosure, a shelter system is provided. The shelter system includes a shelter including a roof, a plurality of side walls, and an enclosed interior space. The shelter in some embodiments is formed by a frame having a plurality of spaced apart, frame members and an outer cover supported by the frame and formed of a flexible material. The shelter system also includes a shade cover formed of a flexible material and mounted over a majority of the roof and a portion of the side walls. In some embodiments, the shade cover includes sections formed of solid, flexible material and at least one section of mesh, wherein the at least one section of the mesh forms a vent. The shelter system further includes means for supporting the shade cover a spaced distance from the shelter so as to define one or more air cavities therebetween.

DESCRIPTION OF THE DRAWINGS

The foregoing aspects and many of the attendant advantages of the claimed subject matter will become more readily appreciated as the same become better understood by reference to the following detailed description, when taken in conjunction with the accompanying drawings, wherein:

DETAILED DESCRIPTION

The detailed description set forth below in connection with the appended drawings where like numerals reference like elements is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed. Similarly, any steps described herein may be interchangeable with other steps, or combinations of steps, in order to achieve the same or substantially similar result.

The following discussion provides one or more examples of a shade cover or "solar fly" for reducing the thermal radiation effects of the sun on an associated shelter. By blocking the sun's rays to a significant degree, the outer surface temperature of an associated shelter is reduced, which results in less heat transfer into the interior space thereof. In other embodiments, natural convection may be advantageously used to aid in reducing heat transfer into the interior space of the associated shelter. Several embodiments, as will be described in more detail below, employ natural convection known as the chimney effect to reduce heat transfer into the interior space of the associated shelter. Such reduction of heat transfer into the interior space reduces the air conditioning load needed to maintain the interior space of the associated shelter at ambient temperatures of, for example, 76-84 degrees Fahrenheit among others.

In the following description, numerous specific details are set forth in order to provide a thorough understanding of exemplary embodiments of the present disclosure. It will be apparent to one skilled in the art, however, that many embodiments of the present disclosure may be practiced without some or all of the specific details. In some instances, well-known process steps have not been described in detail in order not to unnecessarily obscure various aspects of the present disclosure. Further, it will be appreciated that embodiments of the present disclosure may employ any combination of features described herein.

Figure 1:
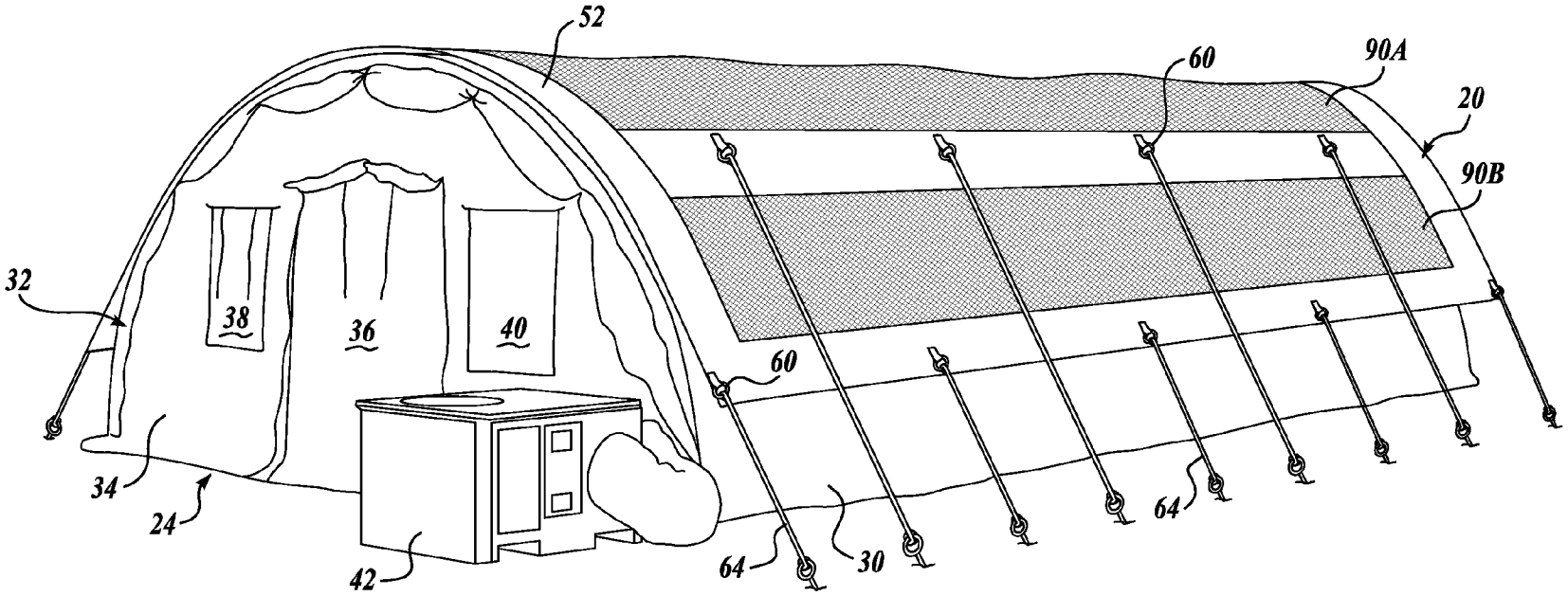
FIG. 1 is a perspective view of one example of a shade cover, as referred to herein as a solar fly, formed in accordance with aspect of the present disclosure, the shade cover shown as mounted over a temporary shelter.

Referring now to FIGS. 1-5, there is shown an example of a shade cover or solar fly, generally designated 20, formed in accordance with aspects of the present disclosure. As best shown in FIG. 1, the solar fly 20 is mounted on an associated shelter 24, such as a temporary, portable shelter, which in some embodiments employs one or more air conditioners 42 to regulate the temperature of the interior space therein. As will be described in more detail below, the solar fly 20 is configured so as form one or more spaces or air gaps 26 (See FIG. 3) between the shelter 24 and the solar fly 20 when mounted on the shelter 24 to allow airflow therein. In use, as will be described in more detail below, the solar fly 20 blocks a majority of the sun's light from hitting the shelter 24, thereby reducing the outer surface temperature of the shelter 24, which in turn, lowers the heat transfer into the interior space thereof. Such reduction of heat transfer into the interior space reduces the air conditioning load needed, or may avoid the need for air conditioning altogether, to maintain the interior space of the shelter at ambient temperatures of, for example, 76-84 degrees Fahrenheit among others.

Figure 2:
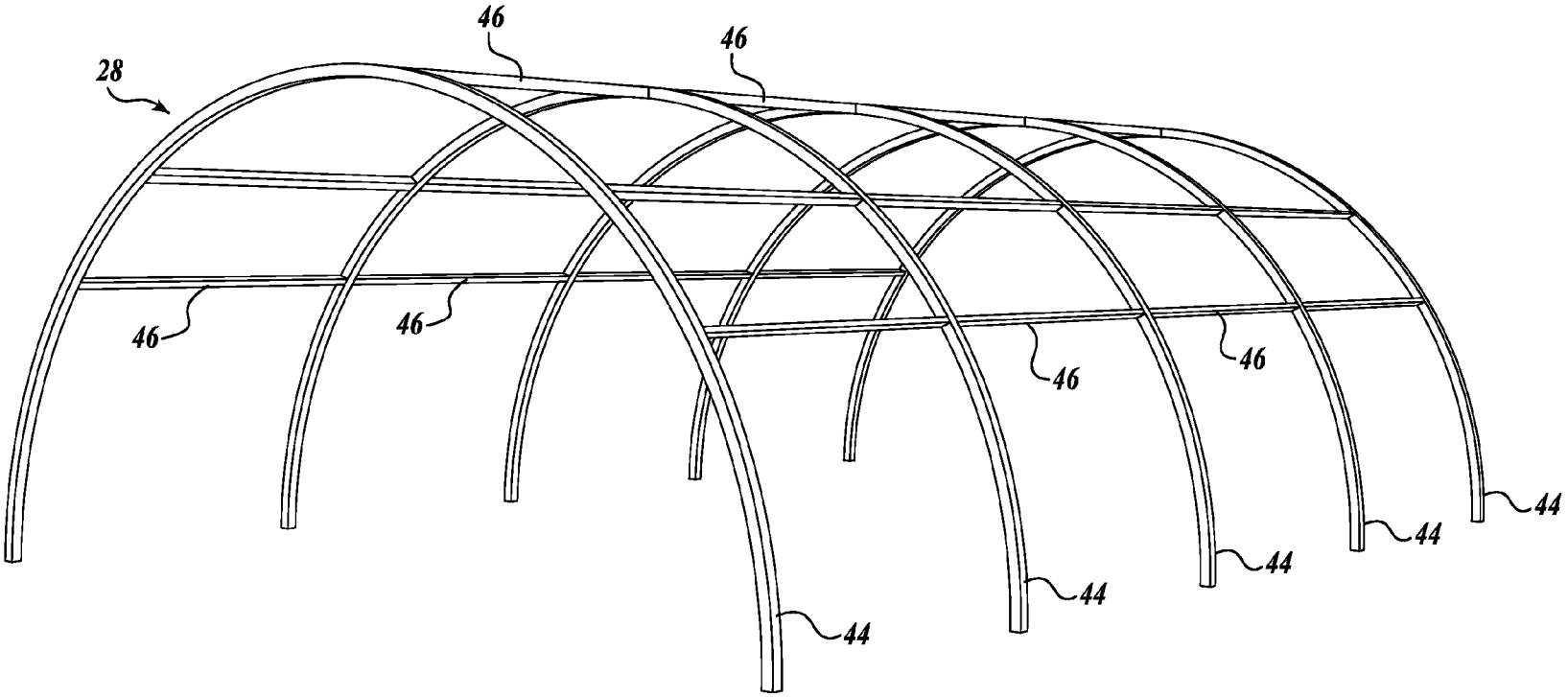
FIG. 2 is one example of a frame of the temporary shelter.
Figure 3:
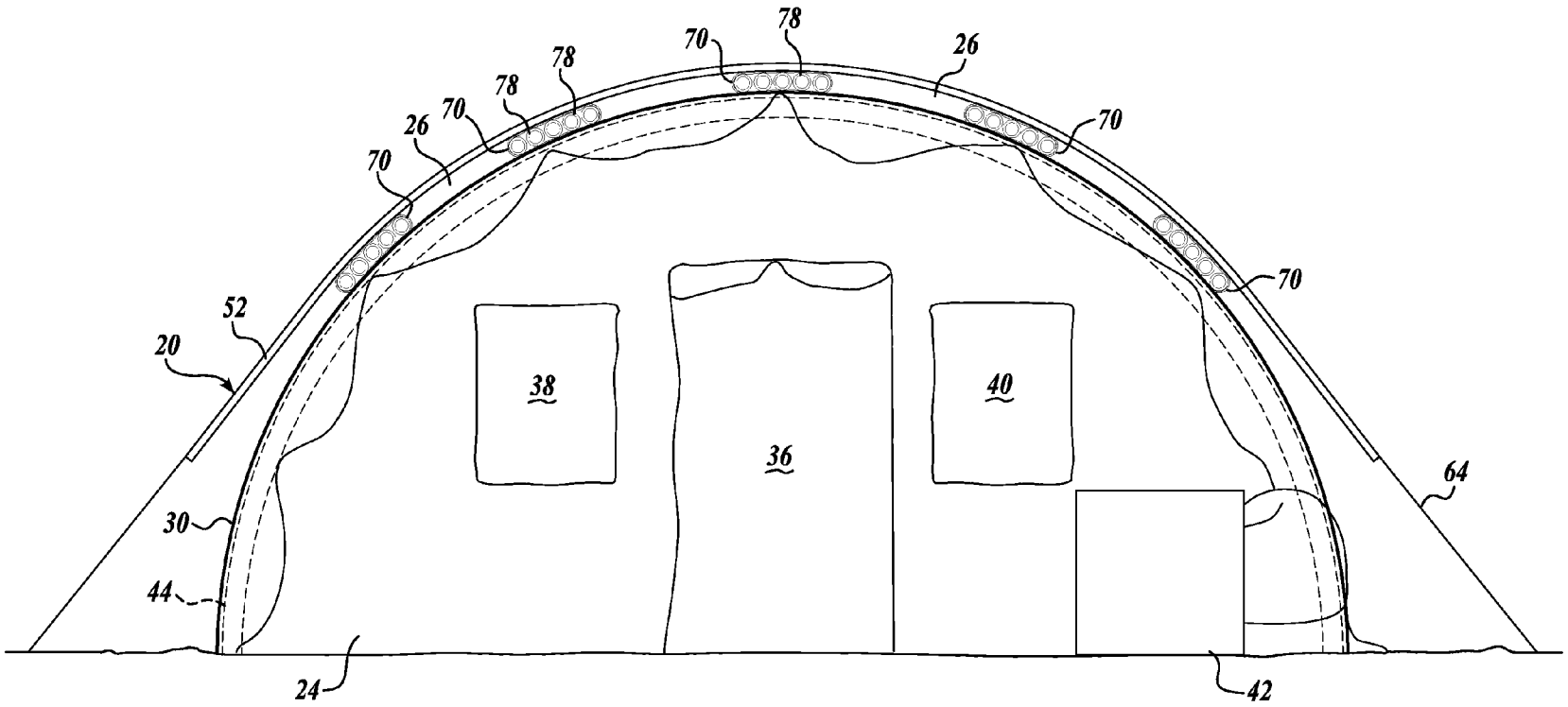
FIG. 3 is a lateral cross section view of the combination shade cover and temporary shelter of FIG. 1.

One example of the shelter 24 that may be practiced with one or more embodiments of the present disclosure is shown in FIGS. 1-3. In the embodiment shown, the shelter is of the compact and portable type, and comprises a lightweight, easy-to-assemble frame 28 (See FIG. 2) covered with a durable, flexible, outer cover 30 and two opposite end walls (only end wall 32 covered with end wall covers 34 is shown in FIG. 1). In the embodiment shown, the frame 28 is arched and includes a plurality of lightweight arched frame supports 44 (See FIG. 2), which in some embodiments can be attached at their opposite ends to an option square or rectangular-shaped base (not shown). The arched frame supports 44 extend transversely over the base and may be formed from a plurality of curved components connected end-to-end. The arched frame supports 44 are vertically aligned and equally spaced apart over the base and interconnected with adjacent arched frame supports by horizontally aligned purlins 46. For more detail regarding one example of a shelter that may be employed in embodiments herein, please see U.S. Pat. No. 6,679,009, entitled "Compact, All-Weather Shelter," the disclosure of which is hereby incorporated by reference. Of course, other temporary and permanent shelters of various shapes may be used.

In the embodiment shown in FIG. 1, the shelter 24 includes a door 36, flank by windows 38 and 40 in the end wall cover 34. The shelter 24 also includes one or more window openings (hidden in FIG. 1) disposed along the longitudinal sides of the outer cover 28. As best shown in FIG. 1, the shelter 24 may further include an air conditioner 42 and associated components for conditioning the interior space of the shelter 24. It will be appreciated that the interior space of the shelter 24 may be occupied by machines, equipment, supplies, etc., occupied by people for sleeping, dining, office, or medical use, etc., and/or the like.

Figure 5:
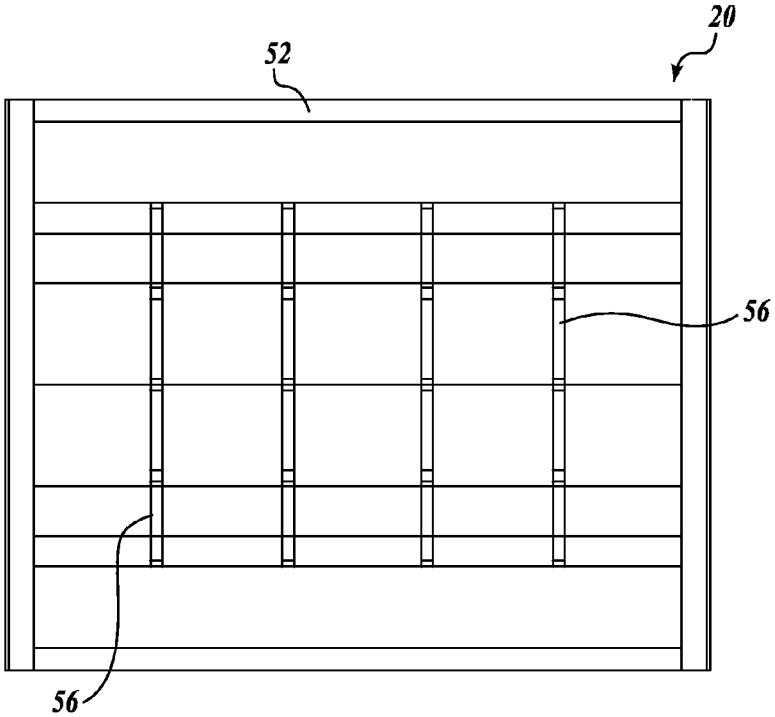
FIG. 5 is a bottom view of the shade cover of FIG. 4.
Figure 4:
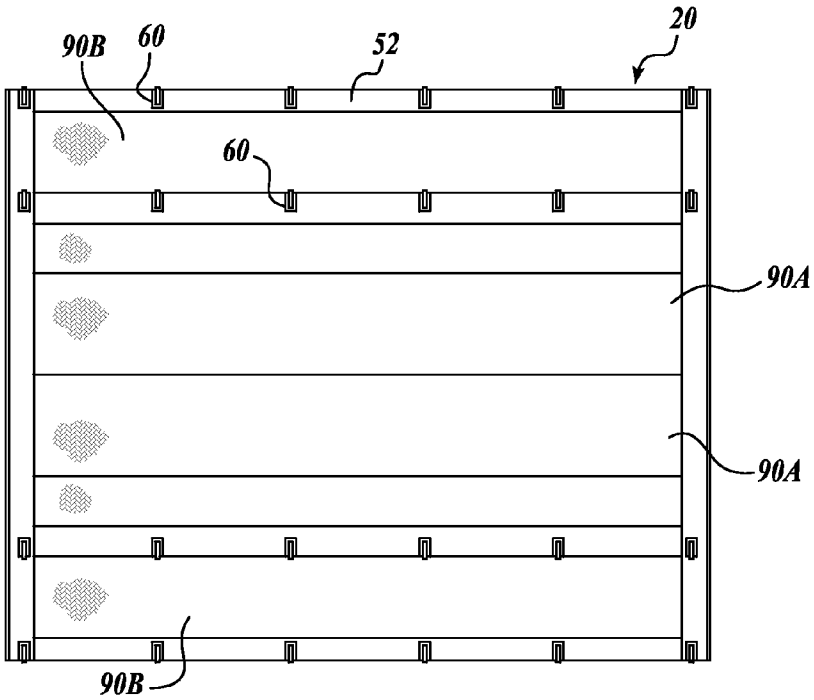
FIG. 4 is a top view of one example of a shade cover formed in accordance with aspect of the present disclosure.

Turning now to FIGS. 1-5, one embodiment of the solar fly 20 will be described in more detail. The solar fly 20 includes a durable and flexible outer cover 52. The outer cover 52 is of sufficient length to completely extend longitudinally over the shelter 24, as best shown in FIG. 1. Also, the outer cover 52 is of sufficient width to extend transversely over the majority of the shelter 24. In one embodiment, the longitudinal edges of the outer cover 52 are positioned approximately 6-60 inches or more above ground or other supporting surface. On the underside of the solar fly 20 as shown in FIG. 5, there is provided a plurality of flaps or fabric sections 56 spaced apart so as to correspond to the spacing of the arched frame supports 44 of shelter 24. On the outer side of the solar fly 20, a plurality of guy wire attachments 60 may be secured thereto, as shown best in FIGS. 1 and 4. The guy wire attachments 60 are configured to be used with a plurality of guy lines 64 in order to secure the solar fly 20 over the shelter 24.

The solar fly 20 further includes transversely extending sleeves, pouches or bags 70 (hidden in FIG. 1 but shown in FIG. 3) secured to flaps or fabric sections 56 (See FIG. 5). In one embodiment, the flaps or fabric sections 56 form sleeves configured to securely hold the bags 70 therein. Alternatively, the bags 70 can be fixedly secured directly to the outer cover 52. The bags 70 may be constructed out of one or more layers of polyester reinforced vinyl fabric, military grade canvas fabrics, nylon fabrics, Cordura® fabrics, military spec. 44103D fabrics, etc. The bags 70 are configured to hold one or more spacers 78. In the embodiment shown, the one or more spacers 78 are in the form of cylindrical tubing sections, although spacers with other cross sections may be employed. In this embodiment, the spacers 78 are freely positioned side by side with their central axis oriented parallel with the longitudinal center line of the outer cover 52. In some embodiments, the one or more spacers 78 are 4 inch diameter aluminum or plastic tubing. In other embodiments, the one or more spacers are semi-rigid foam or the like. In use, when the outer cover 52 is mounted over the shelter 24, the bags 70 of the one or more spacers 78 align with the arched frame supports 44, conform with the geometry of the arched frame supports 44, and support the outer cover 52 a spaced distance from the shelter 24, thereby forming a plurality of air gaps 26 therebetween.

The outer cover 52 in one embodiment is made of one or more layers of polyester reinforced vinyl fabric, military grade canvas fabrics, nylon fabrics, Cordura® fabrics, military spec. 44103D fabrics, etc. The outer cover 52 also includes semi-permeable panels or sections 90A and 90B positioned in various locations of the outer cover 52. In that regard, the outer cover 52 in several embodiments includes one or more longitudinally extending sections 90A of mesh, such as vinyl mesh fabric, vinyl coated mesh, nylon mesh, military grade mesh fabric, wire mesh, etc., positioned at or near the crest or apex of the roof of the solar fly 20 when mounted over the shelter 24. The interstices of the longitudinally extending sections 90A of mesh are sized and configured so as to permit air flow through the outer cover 52, and in some embodiments, the interstices may be of a diamond configuration, hexagonal configuration, rectangular configuration, etc., just to name a few. As will be described in more detail below, the sections 90A may act like a vent to allow hot, rising air to escape through the solar fly 20 from the space 26, which may in turn, pull cooler air from the bottom of the longitudinal sides and ends of the shade shelter, thereby creating convection sometimes referred to as a chimney effect. In some embodiments, the interstices of the sections 90B, which are positioned on the sides of the outer cover 52 at approximately the height of the windows of the associated shelter 24, are sized and configured so as to provide visibility to the occupants of the shelter 24 so that the occupants may see through the windows and out through the outer cover 52. For more details regarding the formation of a chimney effect, please see co-pending application Ser. No. 13/294,979, filed Nov. 11, 2011, the disclosure of which is hereby incorporated by reference.

In several embodiments, the mesh sections 90 provide between approximately 55-90% solar protection from the sun's rays. In one embodiment, the sections 90 provide approximately 85% solar protection from the sun's rays. In these or other embodiments, an optional blackout layer may be attached along the interior surface of the outer cover 52 in areas other than in the semi-permeable sections, which solely, or in combination with the outer cover 52, aid in the prevention of light emission into air gaps 26 (FIG. 3). In one embodiment, the blackout layer is chosen so that the outer cover 52 provides greater than 80% and up to 100% solar protection from the sun's rays. One or more materials that can be employed in the blackout layer include but are not limited to carbon, carbon blends, etc. The outer cover 52 may have a camouflaged exterior color that matches the environment, if desired.

Figure 6:
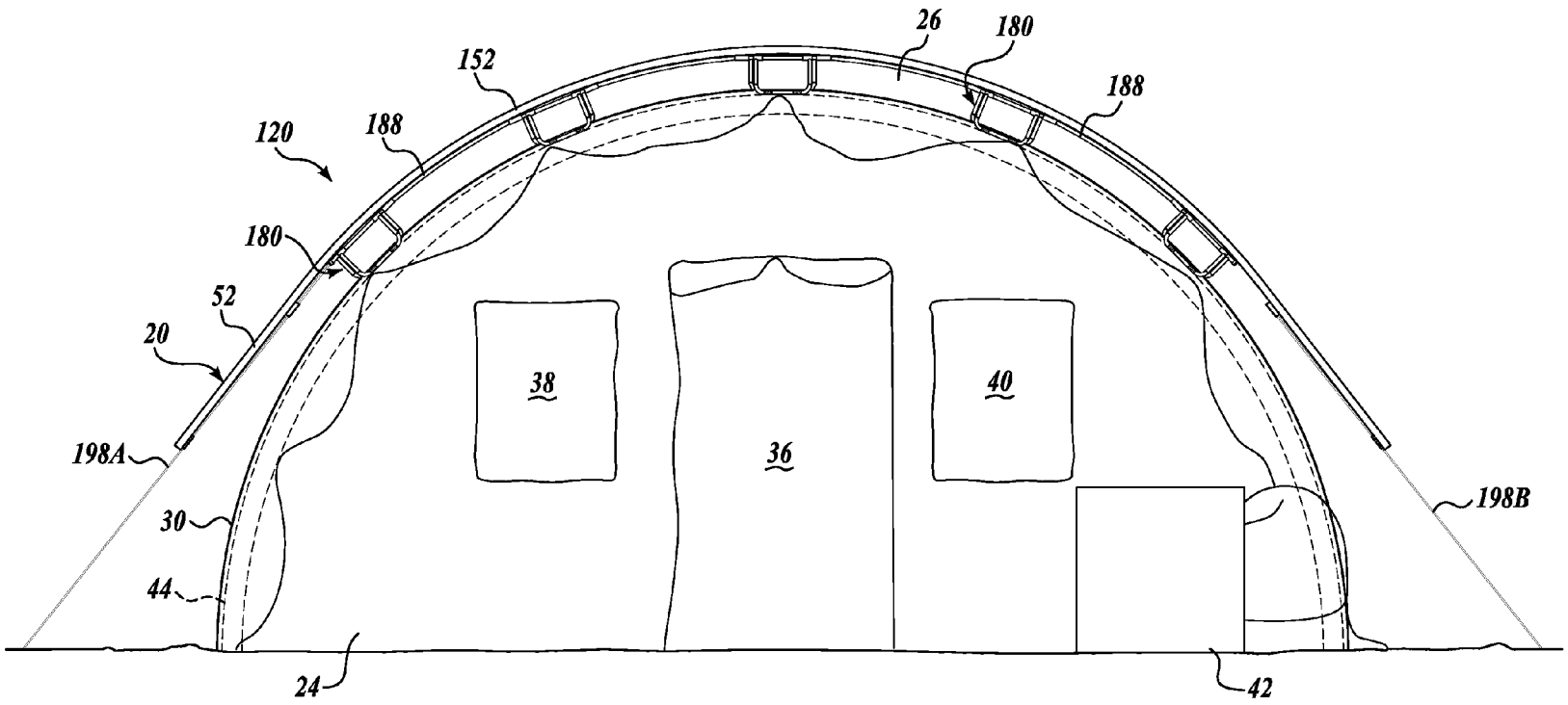
FIG. 6 is a lateral cross section view of another example of a solar fly mounted over a shelter.
Figure 7:
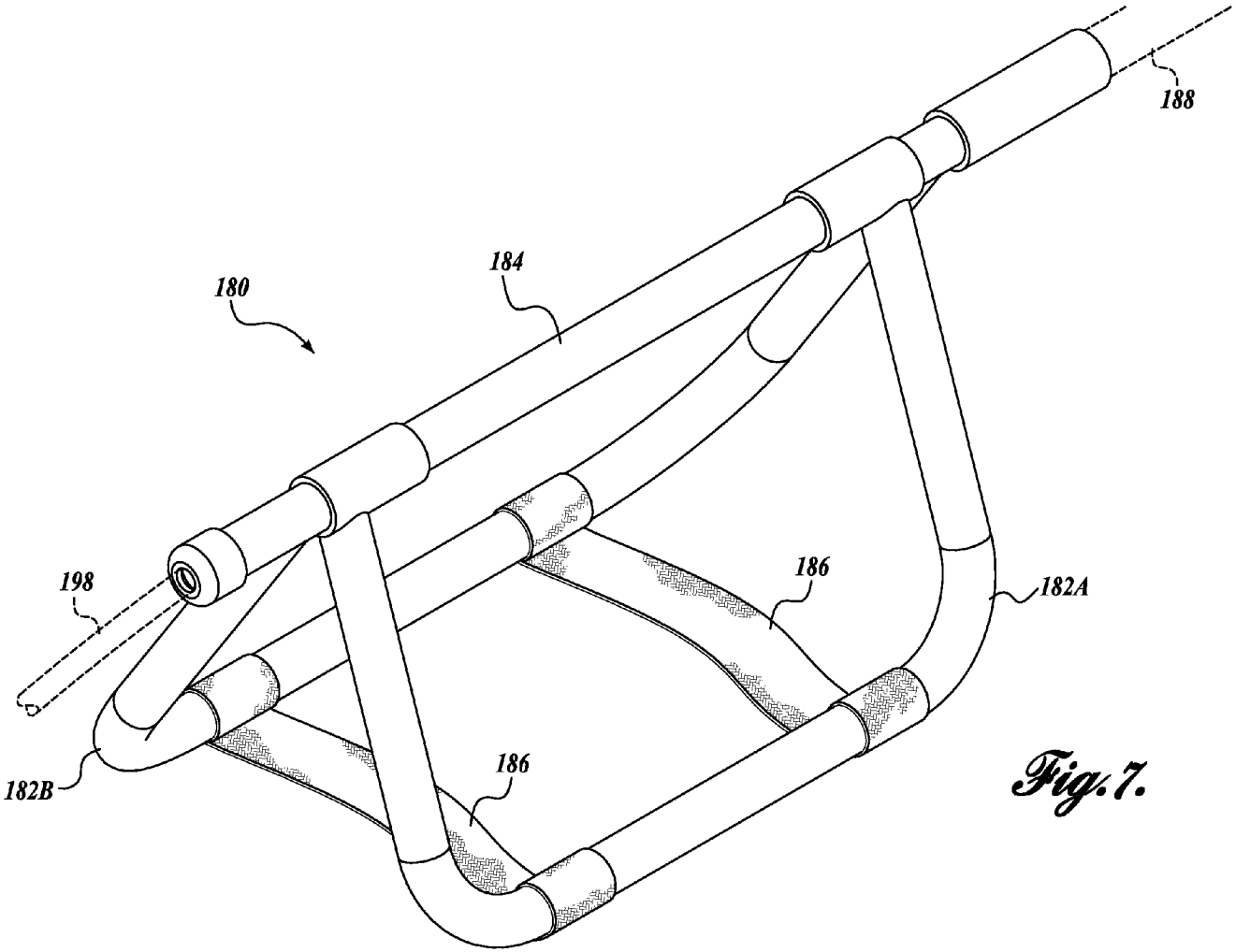
FIG. 7 is a partial view of one example of a foldable frame of a spacer frame system formed in accordance with aspects of the present disclosure.
Figure 8:
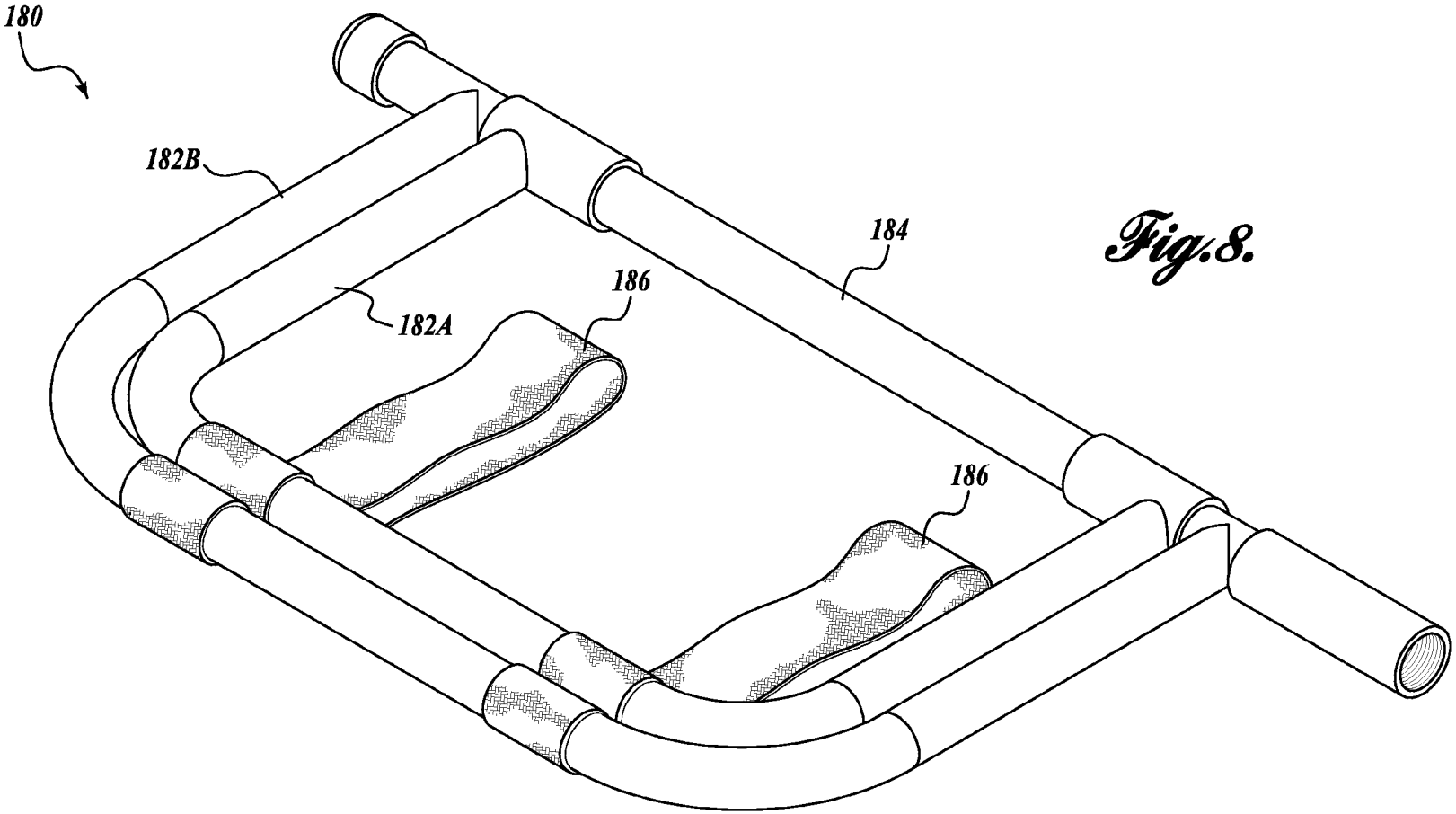
FIG. 8 illustrates one example of a foldable frame formed in accordance with aspects of the present disclosure; the foldable frame in a collapsed position.

FIG. 6 illustrates another embodiment of a solar fly, generally designated 120, formed in accordance with aspects of the present disclosure. The solar fly 120 is substantially similar in configuration, construction and operation as the solar fly 20 described above except for the differences that will now be described in detail. In lieu of the bags 70 and spacers 78, the solar fly 120 includes a spacer frame system comprised of a plurality of spaced apart foldable frames 180 that form one or more gaps between the outer cover 152 of the solar fly 120 and the associated shelter 24. As best shown in FIGS. 7 and 8, the foldable frames 180 each include first and second frame legs 182A and 182B coupled together at central shaft 184. In the embodiment shown, the first leg 182A is configured to pivot with respect to the second leg 182B about a central axis defined by the central shaft 184 from a collapsed position shown in FIG. 8 to an open position shown in FIG. 7. The degree of pivoting movement is constrained by webbing 186, such as straps or the like. When assembled, the foldable frames 180 staddle the arch frame supports 44 of the associated shelter 24 as the spacer frame system extends over the arch frame supports 44.

The plurality of foldable frames 180 are interconnected by a plurality of tubing segments 188. The tubing segments 188 are configured in such a manner as to allow bending of a sufficient amount to match the profile of the shelter 24. In the embodiment shown, the tubing segments 188 are flexible enough to bend to the profile of the arch frame supports 44. In one embodiment, the tubing segments 188 are threadably coupled to the central shafts 184 of adjacent foldable frames 180 via suitable joints, although other coupling techniques may be used. When assembled, rope segments 198A and 198B are secured to the outermost foldable frames 180 and anchored into the ground via a ground spike or the like. In other embodiments, a rope 198 is routed through the center of the central shaft 184 of each foldable frame 180 and the interconnecting tubing segments 188. Each end of the rope 198 is then anchored into the ground via a ground spike or the like.

One operation of the solar fly 20 will now be described with reference to FIGS. 1-8. As described above, the solar fly 20 is supported over a shelter 24 via the spacers 78 or spacer frame assemblies 180, creating one or more contiguous spaces 26 between the inner surface of the solar fly 20 and one or more sections of the outer surface of the shelter 24. In some embodiments, the distance between the inner surface of the solar fly 20 and one or more sections of the outer surface of the shelter 24 is in the range of between about two (2) inches to about twelve (12) inches or more. It will be appreciated that the distance is dependent, in part, on the height of the spacers and tautness of the solar fly 20 via the guy lines 64, etc.

Once supported, the solar fly 20 aims to reduce the thermal radiation effects of the sun on the shelter 24. By blocking as much of the sun's rays as possible, the outer surface temperature of the outer cover 30 of the shelter 24 is reduced, which results in less heat transfer into the interior space thereof. Additionally, the space 26 delimited by the solar fly 20 and the shelter 24, the semi-permeable area 90A located at or near the peak of the solar fly 20, and access to the space 26 from the open ends and/or below the longitudinal edges of the solar fly form a beneficial air flow pattern, sometimes referred to as a chimney effect. As a result, the natural convection of heated air flows upwardly and escapes or vents through area 90A, while cooler air is drawn into the space from below. Cooler air may also enter the space through areas 90B. As such, movement of cooler air across the outer surface of outer cover 30 aims to reduce heat transfer into the interior spaces of the shelter. Such reduction of heat transfer into the interior space reduces the air conditioning load needed to maintain the interior space of the shelter at ambient temperatures of, for example, 76-84 degrees Fahrenheit.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

The embodiments of the invention in which an exclusive property or privilege is claimed are defined as follows:

1. A shelter system, comprising:

a shelter including a roof, a plurality of side walls, an enclosed interior space;

a flexible outer cover; mounted over at least a majority of the roof; and a plurality of spacers positioned on and supported by the roof, two or more of the spacers being linked together by at least one connector segment, the plurality of spacers positioned between the roof and the outer cover so as to support the cover a spaced distance outwardly of the shelter, thereby creating an air cavity between the roof and the cover, wherein each of the plurality of spacers includes:

a central shaft, and first and second frame legs coupled together at said central shaft, wherein the first and second leg members are pivotally coupled about the central shaft.

2. The shelter system of claim 1, wherein the outer cover includes one or more sections of mesh.

3. The shelter system of claim 2, wherein a section of the one or more sections of mesh is located at or near the apex of the outer cover when supported by the shelter.

4. The shelter system of claim 1, wherein the outer cover includes sections formed of solid, flexible material and at least one section of mesh, wherein the at least one section of the mesh forms a vent.

5. The shelter system of claim 1, further comprising webbing extending between the first and second frame legs so as to constrain a degree of pivotable movement of the first and second frame legs with respect to the central shaft.

6. The shelter system of claim 1, further comprising a plurality of tubing segments interconnecting ones of the plurality of spacers through respective central shafts.

7. A shelter system, comprising:

a shelter including a roof, a plurality of side walls, and an enclosed interior occupiable space, the shelter formed by a frame having a plurality of spaced apart, arched frame members and wherein the roof is an outer cover supported by the frame and formed of a flexible material;

a shade cover formed of a flexible material and mounted over a majority of the roof and side walls of the shelter, wherein the shade cover includes one or more sections formed of solid, flexible material; and a plurality of spacers configured to support the shade cover a spaced distance from the shelter so as to define one or more air cavities therebetween, wherein each of the plurality of spacers includes:

a central shaft; and first and second frame legs coupled together at said central shaft.

8. The shelter system of claim 7, wherein the shade cover further includes at least one section of mesh, wherein the at least one section of the mesh forms a vent so positioned as to correspond to near or at the apex of the shade cover, the vent allowing air flow from the one or more air cavities to an area exteriorly of the shade cover.

9. The shelter system of claim 7, wherein the first and second leg members are pivotally coupled about the central shaft, wherein the first and second leg members are supported by the shelter.

10. The shelter system of claim 9, wherein the first and second leg members straddle an arched frame member.

11. The shelter system of claim 9, further comprising:

at least one connector segment linking two or more spacers together, and a rope routed through the two or more spacers and, wherein the at least one connector segment is tied to a support surface for securing the two or more spacers to the shelter.

12. The shelter system of claim 7, further comprising webbing extending between the first and second frame legs so as to constrain a degree of pivotable movement of the first and second frame legs with respect to the central shaft.

13. The shelter system of claim 7, further comprising a plurality of tubing segments interconnecting ones of the plurality of spacers through respective central shafts.

14. A shelter system, comprising:

a shelter including a plurality of side walls, and an enclosed interior occupiable space, the shelter formed by a frame having a plurality of spaced apart, frame members and a flexible outer cover supported by the frame and formed of a flexible material;

a shade cover formed of a flexible material and mounted over a majority of a surface area of the flexible outer cover and a portion of the side walls, wherein the shade cover includes sections formed of solid, flexible material and at least one section of mesh, wherein the at least one section of the mesh forms a vent; and a spacer frame system that supports the shade cover a spaced distance from the flexible outer cover so as to define one or more air cavities therebetween, the spacer frame system comprising a plurality of spaced apart foldable frames, each of the foldable frames comprising:

a central shaft;

first and second frame legs pivotably coupled to said central shaft; and webbing extending between the first and second frame legs so as to constrain a degree of pivotable movement of the first and second frame legs with respect to the central shaft.

15. The shelter system of claim 14, further comprising a plurality of tubing segments interconnecting ones of the plurality of foldable frames through respective central shafts.

* * * * *